United States Patent [19]

Miller

[11] Patent Number: 4,873,153

[45] Date of Patent: Oct. 10, 1989

[54] HOT-DIP GALVANIZED COATING FOR STEEL

[75] Inventor: George T. Miller, Lewiston, N.Y.

[73] Assignee: Occidental Chemical Corporation, Niagara Falls, N.Y.

[21] Appl. No.: 93,946

[22] Filed: Aug. 28, 1987

Related U.S. Application Data

[63] Continuation-in-part of Ser. No. 66,366, Jun. 25, 1987.

[51] Int. Cl.[4] ..... B32B 15/18; B05D 1/18

[52] U.S. Cl. ..... 428/659; 427/419.7; 427/433; 428/570

[58] Field of Search ..... 428/570, 659; 106/1.17; 204/44.2; 427/419.7, 433

[56] References Cited

U.S. PATENT DOCUMENTS

| | | | |
|---|---|---|---|
| 4,011,088 | 3/1977 | Makishima et al. | 106/1.17 |
| 4,110,117 | 8/1978 | McLeod | 106/1.17 |
| 4,470,897 | 9/1984 | Iezzi et al. | 204/44.2 |

FOREIGN PATENT DOCUMENTS

| | | | |
|---|---|---|---|
| 174019 | 3/1986 | European Pat. Off. | 428/659 |

*Primary Examiner*—Robert McDowell

*Attorney, Agent, or Firm*—James F. Tao; Richard D. Fuerle; Arthur S. Cookfair

[57] ABSTRACT

A hot-dip galvanized coating for improved resistance welding of galvanized steel parts or sheets includes particles of a metal phosphide, and preferably ferro-phosphorus particles, having a particle size of from about 0.1 to about 30 microns such particles being included in the galvanized coating while the zinc is still molten. The coating can also include up to about 40% by weight of the metal phosphide of an additional metal such as nickel, tin, aluminum or lead, which can be incorporated in the coating as discrete particles or deposited onto the surface of the metal phosphide particles.

The advantages of the present invention include a significant reduction in welding current and an increase in electrode life, as well as simplified application of the coating by incorporating the metal phosphide particles directly into existing coating lines.

12 Claims, No Drawings

HOT-DIP GALVANIZED COATING FOR STEEL

CROSS-REFERENCE TO RELATED APPLICATION

This application is a continuation-in-part of U.S. application Ser. No. 066,366, filed on June 25, 1987.

BACKGROUND OF THE INVENTION

The present invention relates to improved hot-dip galvanized (zinc or zinc alloy) steel parts or sheets obtained by including a metal phosphide pigment, and preferably a ferrophosphorus pigment, in the hot-dip galvanized layer. The welding improvements realized by practicing the present invention are improved weldability lobes and dynamic resistance curves for better welding control for resistance welding systems, as well as increased electrode life and improved appearance and paintability.

The use of galvanized steel sheets in the automotive industry has become increasingly popular in recent years due to the increase in concern for corrosion protection for automobile body panels. Corrosion problems are particularly severe in environments where salt is used for preventing the icing of snow on highway roads. Although efforts have been made to enhance the corrosion-resistance of steel sheets, such as by using various chemical conversion treatments and paint coatings, the corrosion protection method of choice currently is galvanized steel, with the galvanized coating formed by either hot-dipping or electrodeposition.

Hot-dip galvanized coatings are applied by dipping or immersing the steel sheet or part in molten zinc to produce a coating having a thickness typically of about 0.003 to 0.15 mm. In a typical modern industrial process, the steel surface is preoxidized at 650° C. and then hydrogen-reduced at 850° C. to 950° C. The temperature is lowered to 400° C. with the strip still protected in hydrogen until it enters the zinc bath. In this way, flux at the entrance to the bath is avoided and small amounts of aluminum are used to inhibit formation of zinc-iron intermetallic intermediate layers. The bath temperature is maintained at 450°–460° C. by the sensible heat of the incoming strip.

The strip can then be jet-finished at line speeds of up to 185 m/min. During this process, the strip rises vertically out of the zinc bath, carrying an entrained viscous layer of molten zinc. A row of horizontal jets of air impinge perpendicularly on one side of the strip, and cause a return flow of liquid metal into the bath. Sensors above the row of air jets meter the thickness of the coating and adjust the velocity of air flow by electronic feedback circuits so that the desired thickness on each side can be maintained continuously throughout the run.

The characteristic spangle of galvanized steel sheets results from the rate of crystallization of the molten zinc, which depends on the condition of the starting steel and the presence of minor additions to the melt. The latter lower the melting point of the zinc and, thereby, lower the cooling rate of the molten layer. Paint adherence on a galvanized sheet depends on the orientation of the zinc crystals in the spangle, but, in general, adherence tends to be not as good as on bare steel. The spangle can be controlled by blowing zinc dust on the molten zinc surface and producing multinucleation sites for crystal formation to provide a highly nucleated, satin finish. However, this does not improve the poor resistance weldability of such coatings due to brass formation as discussed below.

Resistance spot welding is used to form joints between two materials. The process uses a set of electrodes to apply pressure to the weld area, to maintain the components in position, and to pass current through the weld. As the current flows, joule heating of the substrate occurs. Due in part to the cooling effects of the electrodes, a molten nugget eventually develops at the weld centerline or faying surface but not at the electrode contact. On cooling, this nugget resolidifies and effects a joining between the two materials. Some of the problems encountered during spot welding of galvanized steel sheets or parts include reduced weldability lobe widths, the absence of a dynamic resistance "beta peak", and decreased electrode life.

When resistance welding uncoated or bare steels, a single set of copper welding electrodes can be expected to make approximately 50,000 welds. When spot welding electrogalvanized steels, however, the zinc forms alloys with the copper electrode tip, forming a brass in situ. The brass sticks to the weld, rapidly eroding the welding tip which must then be replaced or refinished. This, in turn, reduces electrode life to about 1000–2000 welds or less. Since the production line must be stopped each time an electrode is replaced, at a considerable expense to the user, the relatively limited electrode life experienced when welding galvanized steels represents a significant economic disadvantage.

The use of ferrophosphorus pigment for both improved corrosion protection and weldability has been suggested in the prior art. For instance, U.S. Pat. No. 3,884,705, issued May 20, 1975, and U.S. Pat. No. 4,119,763, issued Oct. 10, 1978, both disclose the use of coatings containing ferrophosphorus and zinc pigments, and a non-metallic corrosion inhibitor such as zinc chromate, as a replacement for zinc-rich coatings. As contemplated in these patents, the ferrophosphorus pigment-containing coating is applied to bare steel panels rather than to galvanized sheets. The ferrophosphorus pigment used in such applications is commercially available from the Occidental Chemical Corporation under the trademark Ferrophos® pigment.

A ferrophosphorus pigment dispersed in a resin to bind adjacent steel plates to form a vibration-damping composite suitable for resistance welding is disclosed in Japanese Patent Application No. 61–41540, published on Feb. 27, 1986.

The use of a coating comprising a resin, ferrophosphorus powder and mica powder applied to a steel sheet having a layer of fused aluminum or an aluminum/zinc alloy is disclosed in Japanese Patent Application No. 591456884, published Aug. 22, 1984. The steel sheet described in this reference can be subjected to chemical conversion, and is further described as having excellent weldability, processability and corrosion and heat resistance.

The use of an iron layer containing less than about 0.5 weight percent phosphorus applied to a zinc/iron or zinc/nickel alloy electroplated steel sheet for improved surface properties is described by Honjo et al. in Internal Journal of Materials and Product Technology, Vol. 1, No. 1, pp. 83–114 (1986).

It will be appreciated by those skilled in the art that a continuing need exists for steel sheets or parts which posess the durability and corrosion resistance of galvanized components, but also possess the weldability advantages of bare steel. It would also be desirable to modify an existing coating line in order to accomplish this objective with minimal expense.

SUMMARY OF THE INVENTION

In accordance with the present invention, a steel sheet or part with improved resistance welding characteristics has a hot-dip galvanized layer containing at least one metal phosphide selected from the group consisting of phosphides of iron, nickel, cobalt, tin, copper, titanium, manganese, molybdenum, tungsten, vanadium, tantalum, and mixtures thereof. Preferably, the metal phosphide is ferrophosphorus pigment having a range of particle sizes of from about 0.1 to about 30 microns, and which is present in the galvanized layer in amounts of from about 0.1% to about 50% by weight of the zinc.

A metal additive for increased electrode life can also be included in the coating in amounts of up to about 40% by weight of the metal phosphide. The metal additive can be added to the coating in particulate form as a separate component, or deposited onto the surface of the metal phosphide particles. Suitable metal additives include nickel, tin, aluminum, lead, and mixtures thereof.

DESCRIPTION OF THE PREFERRED EMBODIMENTS

The steel sheets or formed parts which are used in the present invention contain a thin layer of zinc metal or a zinc alloy which is in direct contact with the steel surface. The steel substrate can vary in thickness, and is typically about 30 mils thick. Thin steel sheets of this type are used extensively in the automotive and appliance industries for forming auto and appliance bodies. The zinc or zinc alloy coating or layer is applied to the steel sheet by a hot-dip galvanizing process where the coating is applied to the substrate by dipping the sheet in molten zinc.

The metal phosphide pigment of the present invention comprises particles having an average size within the range of from about 0.1 to about 30 microns, and is present in the galvanized layer in amounts of from about 0.1% to about 50% by weight of the zinc. Particles within the desired size ranges are suitably obtained by pulverizing the metal phosphide using conventional techniques. Suitable metal phosphides include phosphides of iron, nickel, cobalt, tin, copper, titanium, manganese, molybdenum, tungsten, vanadium, tantalum, as well as mixtures of these metal phosphides. The preferred metal phosphide is iron phosphide, which includes various ratios of iron and phosphorus, and particularly ferrophosphorus, which is an iron phosphide compound containing from about 20% to 28% of phosphorus and corresponding chemically to a mixture of $Fe_2P$ and FeP. Ferrosphosphorus is obtained as a by-product in the commercial manufacture of elemental phosphorus by the electric furnace reduction of phosphate ores, with the iron present in the phosphate ores forming the ferrophosphorus. Ferrosphosphorus typically contains impurities, of which silicon and manganese are the major impurities, typically being present in amounts of up to 5% by weight, and is further characterized as being electrically conductive, brittle, and substantially unreactive in water, dilute acidic or alkaline environments. A particularly suitable ferrophosphorus pigment is Ferrophos pigment which is manufactured and sold by the Occidental Chemical Corporation.

The metal phosphide can be advantageously incorporated directly into the zinc metal or zinc alloy galvanized coating by modifying the commercial line to incorporate suitable amounts of the metal phosphide particles. The metal phosphide particles can be sprayed directly onto the molten zinc coating which has been applied to the steel surface by hot-dipping. The metal phosphide particles contact the zinc while it is still molten, thus allowing nucleation of zinc crystals to occur. The melting point of ferrophosphorus is substantially higher than the melting point of zinc, i.e. approximately 1,320° C. compared to 420° C., thereby permitting the formation of a satin finish instead of the spangle finish normally present on hot-dip galvanized surfaces. This is accomplished by substituting the metal phosphide for the zinc powder which is used to prevent spangling in hot-dip galvanizing operations. This results not only in improved paintability as would be expected, but also improved resistance welding characteristics as well.

The metal phosphide particles are applied to the molten zinc surface in an amount of from about 0.1% to about 50% by weight of the zinc. The metal phosphide particles are uniformly applied to the zinc surface to insure good adhesion and a smooth finish using well know techniques.

An additional metal, such as nickel, tin, aluminum, lead, and mixtures thereof, can also be incorporated into the molten zinc coating by direct application to the zinc surface. Alternatively, the additional metal can be deposited directly onto the surface of the metal phosphide particles using techniques which are well-known to those skilled in the art, such as by physically grinding or blending mixtures of the metal phosphide and added metal in the desired proportions, or by immersion coating, etc. The metal particles have an average size within the range of about 0.1 to about 30 microns. Amounts of additional metal of up to about 40% by weight, based on the weight of metal phosphide, are suitable.

The following specific examples are provided as exemplary of various embodiments of the present invention, but are not intended to limit the full scope of the invention as defined by the appended claims.

EXAMPLE 1

A 1-¼ wide by 9" long strip of highly spangled hot-dip galvanized steel was inserted 12" into a 1-½" diameter glass tube having a side arm at one end. A rubber stopper was placed in one end of the glass tube, and a slow flow of nitrogen gas was introduced into the side arm. A glass blower's torch having a broad brush flame was used to heat the upper end of the galvanized strip. Melting of the zinc only occurred at the upper end of the strip. The tube was allowed to cool under nitrogen.

A ten (10) power micrograph was made of the interface area between the unmolten and melted areas of the strip. Upon cooling, the crystal structure of the "spangled" hot-dip galvanized surface was observed to be re-established.

EXAMPLE 2

The procedure of Example 1 was repeated. The rubber stopper was removed from the tube and a quick squirt of a mist of Ferrophos particles having an average size of three (3) microns was propelled into the tube using a neutral propellant (Medici Aerosol Universal Multi-Mist). The stopper was replaced, the flame was removed, and the galvanized strip was allowed to cool under nitrogen.

A ten (10) power micrograph was made of the interface area between the unmolten and melted areas. Upon cooling, there was no spangling, and a satin finish was observed on the strip indicating that micro-nucleation had occurred.

EXAMPLE 3

The procedure of Example 2 was repeated using a 1" by 5" strip of hot-dip galvanized steel. Four (4) inches of the galvanized strip was observed to have a uniform and non-spangled finish. Under 400 power magnification, the formation of tiny crystals appeared to have occurred on the surface.

The strip was bent in the middle to give a 1" by 2-½" sandwich. Nine spot welds were made on the strip using a 5,500 amp, Miller spot-welder, Model M5W-41T, at 15 cycles. The top welds were made on the Ferrophos containing portion of the strip, while the bottom welds were made on the regular hot-dip galvanized portion which did not contain Ferrophos.

Visual inspection of the welds, both without magnification and a 12 power magnification, showed significant brass formation in the bottom spot welds with at crack in the coating around the weld. No brass formation was evident in the top welds.

Although the present invention has been described with respect to several illustrative embodiments, it should not be interpreted as being so limited. As will be evident to those skilled in the art, other substitutions and equivalents are possible without departing from the spirit of the invention or the scope of the claims.

What is claimed is:

1. An article having improved resistance welding characteristics consisting essentially of a steel substrate having a hot-dip coating of zinc metal or a zinc alloy containing discrete particles of at least one metal phosphide selected from the group consisting of phosphides of iron, tin, titanium, manganese, tungsten, vanadium, tantalum, and mixtures thereof, said hot-dip coating being applied to the steel substrate by immersing the substrate in a molten bath of zinc or zinc alloy and spraying the molten zinc or zinc alloy with said discrete particles whereby said discrete particles are deposited on the surface of said zinc or zinc alloy.

2. The article of claim 1 wherein the metal phosphide is ferrophosphorus.

3. The article of claim 2 wherein the zinc coating has a thickness of from about 0.003 mm to about 0.15 mm.

4. The article of claim 2 wherein the ferrophosphorus particles have an average size within the range of about 0.1 to about 30 microns.

5. The article of claim 2 wherein the ferrophosphorus particles are present in the coating in an amount of from about 0.1% to about 50% by weight of the zinc.

6. The article of claim 2 wherein the coating also contains particles of an additional metal selected from the group consisting of tin, aluminum, lead, and mixtures thereof, in an amount up to about 40% by weight based on the weight of the metal phosphide.

7. The article of claim 6 wherein the metal is present as discrete particles having an average size within the range of about 0.1 to about 30 microns.

8. An article having improved resistance welding characteristics consisting essentially of a steel substrate having a hot-dip coating of zinc metal or a zinc alloy containing discrete particles of ferrophosphorus coated with up to about 40% by weight of the ferrophosphorus with a layer of an additional metal selected from the group consisting of tin, aluminum, lead, and mixtures thereof, said hot-dip coating being applied to the steel substrate by immersing the substrate in a molten bath of zinc or zinc alloy and contacting the molten zinc or zinc alloy with said discrete particles.

9. An improved hot-dip galvanizing process for steel substrates comprising the steps of:

(a) immersing a steel substrate in a bath of molten zinc to provide a thin zinc coating on the substrate, (b) contacting the zinc coating with discrete particles of at least one metal phosphide while the zinc is still molten, said metal phosphide being selected from the group consisting of phosphides of iron, nickel, cobalt, tin, copper, titanium, manganese, molybdenum, tungsten, vanadium, tantalum, and mixtures thereof, said metal phosphide particles having an average size within the range of about 0.1 to about 30 microns, and (c) allowing the coating to cool and solidify.

10. The process of claim 9 wherein the metal phosphide is ferrophosphorus.

11. The process of claim 10 wherein the ferrophosphorus particles are present in an amount of from about 0.1% to about 50% by weight of the zinc.

12. The process of claim 10 wherein the thickness of the zinc coating is from about 0.003 mm to about 0.15 mm.

* * * * *